US006037282A

United States Patent [19]

Milding et al.

[11] Patent Number: 6,037,282

[45] Date of Patent: Mar. 14, 2000

[54] NONWOVEN MATERIAL COMPRISING A CERTAIN PROPORTION OF RECYCLED FIBRES ORIGINATING FROM NONWOVEN AND/OR TEXTILE WASTE

[75] Inventors: Ebbe Milding, Mölnlycke; Ulf Holm, Göteborg, both of Sweden; Gerhard Lammers, Noordbergum, Netherlands

[73] Assignee: SCA Hygiene Paper AB, Goteborg, Sweden

[21] Appl. No.: 08/776,750

[22] PCT Filed: Aug. 17, 1995

[86] PCT No.: PCT/SE95/00938

§ 371 Date: Feb. 13, 1997

§ 102(e) Date: Feb. 13, 1997

[87] PCT Pub. No.: WO96/06222

PCT Pub. Date: Feb. 29, 1996

[30] Foreign Application Priority Data

Aug. 22, 1994 [SE] Sweden ..... 9402804

[51] Int. Cl.[7] ..... D04H 1/46

[52] U.S. Cl. ..... 442/408; 442/340; 442/344; 442/164; 442/165; 442/152; 442/153; 428/903.3

[58] Field of Search ..... 442/153, 164, 442/165, 340, 344, 408; 428/903.3; 28/104

[56] References Cited

U.S. PATENT DOCUMENTS

| | | | |
|---|---|---|---|
| 4,100,324 | 7/1978 | Anderson et al. | 428/288 |
| 4,879,170 | 11/1989 | Radwanski et al. . | |
| 4,931,355 | 6/1990 | Radwanski et al. . | |

FOREIGN PATENT DOCUMENTS

| | | |
|---|---|---|
| 841 938 | 5/1970 | Canada . |

*Primary Examiner*—Christopher Raimund
*Attorney, Agent, or Firm*—Burns, Doane, Swecker & Mathis, L.L.P.

[57] ABSTRACT

Nonwoven material produced by hydroentangling a fiber web, comprising recycled fibers with a fiber length of between 5 and 60 mm and a fineness of between 0.1 and 20 dtex, which are constituted by fibers which are mechanically shredded or torn from nonwoven waste, textile waste or the like. The fibers are mixed with each other and possibly with new fibers in a wet-formed, foam-formed, air-laid or dry-laid fiber web which is hydroentangled with sufficient energy for forming a compact absorbent material.

10 Claims, No Drawings

NONWOVEN MATERIAL COMPRISING A CERTAIN PROPORTION OF RECYCLED FIBRES ORIGINATING FROM NONWOVEN AND/OR TEXTILE WASTE

BACKGROUND OF THE INVENTION

The present invention relates to a nonwoven material produced by hydroentangling a fibre web.

Hydroentangling or spunlacing is a technique which was introduced in the 1970's, see e.g. CA patent No. 841,938. The method involves forming a fibre web, either dry-laid or wet-laid, whereafter the fibres are entangled, i.e. tangled together by means of very fine water-jets under high pressure. A plurality of rows of water-jets are directed at the fibre web which is supported by a moving wire (mesh). The entangled fabric is then dried. The fibres which are used in the material can be constituted by staple fibres, e.g. polyester, rayon, nylon, polypropylene and the like, by pulp fibres or by mixtures of pulp fibres and staple fibres. Spunlace materials can be produced cheaply and presents high absorption characteristics. Amongst other things they are used as drying materials for household or industrial use and as disposable materials within the field of health-care etc.

Increased environmental awareness has led to the fact that a sparing use of our natural resources in the form of raw materials and sources of energy etc. is more and more often viewed as being a matter of course. Recycling of paper fibres by collection of returned paper and textiles to charity collections has been known for a long time and is used commercially today for producing new products which function perfectly well.

Nonwoven waste of e.g. spunlace type can be recycled by melting it down into plastic granulate which can be used for production of new synthetic fibres. This presupposes that the waste is constituted by relatively "clean" synthetic material based on thermoplastic synthetic fibres. One example is recycling of polyester from bottles for producing polyester fibres which are used for carpet manufacture.

It is also known to mechanically shred nonwoven and textile waste and to use the freed recycled fibres. In this case, mixed waste comprising both synthetic and natural fibres can even be used. New materials for, for instance, sound insulation, filters and geotextiles can be produced from the recycled fibres by thermobinding, needling or adhesive binding.

A large portion of the production waste from nonwoven manufacture however presently goes to dumps as landfill or to waste incineration plants. Such production waste emanates from edge-trimming of the material webs, start-up waste and material which is discarded for various reasons. To the nonwoven waste is added used material as well as production waste.

OBJECT AND FEATURES OF THE INVENTION

The object of the present invention is to achieve a nonwoven material with good absorption characteristics and good quality in other aspects, where recycled fibres of the aforementioned type are utilised. This has been solved by the invention in that the material comprises recycled fibres with a fibre length of between 5 and 60 mm and a fineness of between 0.1 and 20 dtex, and which are constituted by fibres which have been mechanically freed from nonwoven waste, textile waste or the like, which fibres are mixed with each other and possibly with new fibres in a wet-formed, foam-formed, air-laid or dry-laid. fibre web which is hydroentangled with sufficient energy for forming a compact absorbent material.

The recycled fibres can be constituted by synthetic fibres, plant fibres, regenerated cellulose fibres or pulp fibres.

By the addition of a suitable binder via impregnation, spraying, application of a coat or the like, certain properties such as wet strength and dry strength of the material can be additionally improved.

DESCRIPTION OF THE INVENTION

The raw material fibre for the recycled fibres can be constituted partly by production waste in the form of edge-trimming waste, start-up waste and by other unused discarded material. It can also be constituted by other waste in the form of used fibre-based materials such as nonwoven and textiles (both woven and knitted). Such material may need to undergo certain cleaning stages, depending on the degree of contamination. The fibres can be recycled by mechanical shredding of the waste, whereby the material is cut into small bits which, with the help of spiked rollers, are torn up so that the fibres are freed. The waste in this case can be constituted by mixed materials, comprising not only natural fibres of different types, such as pulp fibres, cotton, jute, ramie etc. but also synthetic fibres, e.g. polyester, polypropylene, regenerated cellulose etc. The equipment for mechanical recycling of fibres from nonwoven and textile material is commercially available from many different machine suppliers.

The recycled fibres may possibly be mixed with fresh fibres, natural and/or synthetic, and formed into a fibre web which can be dry-laid, air-laid and carded, wet-formed or foam-formed, i.e. the fibres are dispersed in a foamed liquid containing tenside and water, whereafter the fibre dispersion is dewatered on a wire (mesh). The proportion of the recycled fibres should be up to between 1 and 100 weight-%, preferably at least 5%. The fibre web thus formed is then subjected to hydroentangling with an energy input which suitably lies in the range of 400 to 800 kWh/ton. Hydroentangling can occur by conventional techniques and with equipment which is supplied by machine manufacturers. A preferred way of producing the material is by the method which is described in the Swedish patent application number 9402470-0, i.e. a foam-formed fibre web is hydroentangled directly following the forming. The advantage with foam-forming is that the freedom of choice of fibres is very large, such that longer fibres can be used with foam-forming than is the case with wet-forming. Additionally, foam-formed fibre webs present a high degree of uniformity in the fibre forming. However, as mentioned above, the fibre web can be formed in other ways than by foam-forming.

With the mechanical tearing of the waste material, the freeing of the fibres is often incomplete so that the recycled fibres can be present partly in the form of flocks. These flocks give non-uniformities in the produced material, which can have certain positive effects like the material having a more textile-like appearance and, in the case where the material is to be used as drying material, the cleaning capacity of the material is increased due to the mechanical friction effect which the non-uniformities produce. A negative effect is however that the non-uniformities in the material can cause reduced strength. For applications where strength is important, this can be increased by the addition of a suitable binder or wet-strengthener. Examples of such are polyamide-epichlorohydrin, EVA, butadiene-styrene, latex etc. The addition of binder can occur in a known manner by impregnation, spraying, application of a layer or the like. A suitable amount of additive is between 0.1 and 10 weight-%, preferably between 1 and 5 weight-% calculated as part of the weight of the material.

The recycled fibres can be mixed with new fibres as mentioned above. For example a suitable method can be to utilise the production waste from one's own nonwoven production of e.g. spunlace material, by tearing up and freeing the fibres from such production waste and mixing in a certain amount of recycled fibres into the raw material fibres. The advantage of this is that the composition of the recycled fibres and the other raw material fibres is the same, which ensures an even quality in the produced material. However, as previously mentioned, the recycled fibres may be constituted by other nonwoven and textile waste and the produced material can be either wholly, or only partially, based on recycled fibres.

The produced material is primarily intended as drying material for household purposes or for large consumers such as workshops, industry, hospitals and other public institutions.

EXAMPLE

Several different materials with varying amounts of included recycled fibres were produced and tested, whereby a comparison was made with a reference material produced from 100% new fibres. The new fibres were constituted by a mixture of 60% coniferous pulp+40% synthetic fibres (PP+PET) 1.7 dtex×12 mm. The waste was constituted by mechanically recycled fibres from spunlace-nonwoven waste comprising a mixture of pulp, polyester (1.7 dtex×12 mm) and rayon fibres (1.7 dtex×6 mm). Fibre webs were produced by wet-forming or foam-forming and then hydroentangling with about 600 kWh/ton, pressed lightly and dried by means of through-blowing. A wet-strengthener (B) of polyamide-epichlorohydrin type was added to certain of the materials in an amount corresponding to 2 weight-% dry substance calculated as part of the total weight of the material. The properties of the material are given in the following table.

TABLE 1

| Property | Units | Method | 100% New fibres | 100% Waste | 50% Waste + 2% B (+48% New fibres) | 25% Waste + 2% B (+73% New fibres) | 98% New fibres + 2% B |
|---|---|---|---|---|---|---|---|
| Surface Weight | $g/m_2$ | SCAN-P 6:75 | 80 | 83 | 79 | 86 | 85 |
| Thickness | μm | SCAN P-47:83 | 420 | 490 | 400 | 420 | 450 |
| Strength in tension, dry L | N/m | SCAN-P 38:80 | 1400 | 650 | 1450 | 1960 | 2320 |
| Strength in tension, dry T | N/m | SCAN-P 38:80 | 650 | 460 | 640 | 930 | 760 |
| Strength in tension, wet L | N/m | SCAN-P 58:86 | 660 | 250 | 640 | 950 | 1130 |
| Strength in tension, wet T | N/m | SCAN-P 58:86 | 320 | 170 | 320 | 480 | 320 |
| Water absorption, 5 secs. | g/g | SIS 25 12 28 *) | 3,8 | 4,1 | 3,8 | 3,9 | 4,1 |
| Water absorption, total | g/g | SIS 25 12 28 *) | 4 | 4,1 | 3,8 | 4 | 4,1 |

It can be concluded that the material produced from 100% waste fibres without addition of binder presented notably lower strength than the reference material, whilst the absorption capability was totally in line with that of the reference material. With the addition of binder and with 50% mixing-in of waste fibres, a material was obtained which was equivalent to the reference material, whilst with a 25% mixing-in of the waste fibres, a material was obtained which was moreover better than the reference material in both dry and wet strength.

We claim:

1. A nonwoven material produced by hydroentangling a fibre web, comprising recycled fibres with a fibre length of between 5 and 60 mm and a fineness of between 0.1 and 20 dtex, wherein said recycled fibres have been mechanically shredded or torn from nonwoven waste or textile waste, and which fibres are mixed with each other and possibly with new fibres in a wet-formed, foam-formed, air-laid or dry-laid fibre web which is hydroentangled with sufficient energy for forming an absorbent material.

2. The nonwoven material according to claim 1, wherein the recycled fibres are constituted by synthetic fibres, plant fibres, regenerated cellulose fibres and/or pulp fibres.

3. The nonwoven material according to claim 2, wherein a certain proportion of the recycled fibres are not completely freed, but form flocks which remain as non-uniformities in the material.

4. The nonwoven material according to claim 3, wherein the certain proportion of the recycled fibres in the material is between 1 and 100%.

5. The nonwoven material according to claim 1, wherein a wet-strengthener or a binder is added to the material by spraying, impregnation, or coating with a layer.

6. The nonwoven material according to claim 5, wherein the proportion of wet-strengthener or binder is between 0.1 to 10 weight-%.

7. A method of producing a nonwoven material according to claim 1, wherein a fibre web is formed by wet-forming, foam-forming, dry-forming or airlaying, said web comprising between 1 and 100% recycled fibres with a fibre length of between 5 and 60 mm and a fineness of between 0.1 and 20 dtex, which are constituted by fibres which have been freed by mechanical tearing of nonwoven waste or textile waste, and forming an absorbent material of entangled fibres by subjecting the fibre web to hydroentangling and thereafter drying the material.

8. The method according to claim 7 wherein the nonwoven waste is constituted by production waste and/or other nonwoven material or textile waste which is torn up and possibly mixed with new fibres before it is allowed to form said fibre web.

9. The method according to claim 7 wherein following hydroentangling, a wet-strengthener or binder is added to the material by means of spraying, impregnation, or coating with a layer.

10. The non-woven material according to claim 5, wherein the proportion of wet-strengthener or binder is between 1 and 5 weight-%.

* * * * *